US005122232A

United States Patent [19]

Lyman et al.

[11] Patent Number: 5,122,232

[45] Date of Patent: Jun. 16, 1992

[54] MULTIPLE STEAM APPLICATOR CONTROLLER

[75] Inventors: Robert A. Lyman, Redwood City; Bruce F. Taylor, San Jose, both of Calif.

[73] Assignee: Measurex Corporation, Cupertino, Calif.

[21] Appl. No.: 593,669

[22] Filed: Oct. 5, 1990

[51] Int. Cl.[5] ..... D21G 1/00

[52] U.S. Cl. ..... 162/198; 100/38; 100/93 RP; 100/73; 162/206; 162/252; 162/263; 162/DIG. 10

[58] Field of Search ..... 162/198, 206, 207, 252, 162/262, 263, 290, DIG. 10; 100/38, 93 RP, 73

[56] References Cited

U.S. PATENT DOCUMENTS

| | | | |
|---|---|---|---|
| 3,981,758 | 9/1976 | Thayer et al. | 156/64 |
| 4,098,641 | 7/1978 | Casey et al. | 162/198 |
| 4,134,781 | 1/1979 | Cerstene et al. | 156/64 |
| 4,370,923 | 1/1983 | Schmidt | 162/253 |
| 4,497,027 | 1/1985 | McGuire et al. | 156/64 |
| 4,642,164 | 2/1987 | Hanhikoskie et al. | 100/93 RP |
| 4,685,221 | 8/1987 | Taylor et al. | 162/207 |
| 4,786,529 | 11/1988 | Boissevain | 427/296 |
| 5,020,469 | 6/1991 | Boissevain | 118/67 |
| 5,049,216 | 9/1991 | Sheed | 156/64 |

OTHER PUBLICATIONS

Tappi Journal/Feb., 1986, "Process Control and Automation of Supercalenders" by Hannu Malkie.

*Primary Examiner*—Karen M. Hastings

*Attorney, Agent, or Firm*—Spensley Horn Jubas & Lubitz

[57] ABSTRACT

The invention provides multiple steam applicators which are used to distribute steam against a web during calendering. The invention includes a primary steam applicator located adjacent a side of the web to which steam is applied. The primary steam applicator has a manifold, a primary inlet valve, and a plurality of steam valves spaced along the primary manifold. Each steam valve regulates a steam flow distributed to a cross-directional section of the web. A secondary steam applicator is located adjacent the side of the web to which steam is applied. The secondary steam applicator has a manifold, a secondary inlet valve, and a plurality of steam valves spaced along the secondary manifold, each steam valve regulating a steam flow distributed to a cross-directional section of the web. A gloss sensor measures the gloss finish of the web. A computer means, responsive to the gloss sensor, computes a cross-directional gloss error by comparing the gloss measurement at each cross-directional section against a predetermined gloss value for the cross-directional section. The computer means also computes a machine-directional gloss error by comparing the average of the gloss measurements against a predetermined average gloss value. A valve control means, responsive to the computer means, adjusts the primary and secondary steam applicator steam valves to minimize the cross-directional gloss error. Finally, a steam pressure controller means, responsive to the computer means, adjusts the primary and secondary inlet valves to minimize the machine-directional gloss error.

10 Claims, 5 Drawing Sheets

10
12
20
18
16
106
SECONDARY STEAM PRESSURE CONTROLLER
pf
102
24
14
18
VALVE CONTROL DEVICE
v[i]
DIGITAL COMPUTER ~102~
100
26
PRIMARY STEAM PRESSURE CONTROLLER
pc
22
104
24
ge[i]
Gp
SCANNING GLOSS GAUGE ~108~

MULTIPLE STEAM APPLICATOR CONTROLLER

BACKGROUND OF THE INVENTION (1) Field of the Invention

The present invention relates generally to the treatment of a web to obtain desired physical characteristics and particularly to a method and apparatus for controlling multiple steam applicators used to distribute steam against the web.

(2) Description of the Related Art

One of the parameters used in grading a web is the gloss of the surface. During paper production, various grades of paper having different surface gloss are produced to suit various applications. Typically, bulk paper is produced in a continuous sheet and wound in rolls having dimensions of 12 to 36 feet in the cross-direction (i.e., across the width of the sheet). Uniformity of gloss on the paper surface is often desirable or necessary. For example, where the roll of paper is cut to size for making various products, the consistency of the gloss of the individual products is dependent upon the uniformity of the gloss of the original bulk paper roll.

Paper production typically involves a calendering process which includes pressing paper between calender rolls to obtain desired physical characteristics. Calendering paper can change its density, thickness, and surface characteristics, including gloss. Steam is frequently applied to paper being calendared so as to moisten and heat the paper and thereby affect certain characteristics. For example, gloss is typically enhanced on the surface of paper by applying steam to the paper surface, followed by pressing the paper between a series of calender rolls, arranged in a stack of alternating hard polished steel rolls and soft or resilient rolls made of cotton. The paper absorbs the steam, and paper fibers at the surface are softened by the heat and moisture. As the steam treated paper surface comes into contact with the calender rolls, it is smoothed by the pressing and rubbing actions of the polished steel roll and the adjacent cooperating soft roll. The degree of gloss enhancement is dependent on the amount of steam applied to the surface.

A common problem encountered in making a glossy finish using steam treatment is its non-uniformity. Localized variations in the amount of steam applied to the surface of the paper may affect the uniformity of the gloss finish. Also, there are other variables in the calendering process such as temperature and calender roll pressure which may affect the amount of steam required for a particular degree of gloss. A more uniform gloss finish can be obtained if the amount of steam directed at different cross-directional sections of the paper surface can be controlled.

Another common problem associated with the application of steam in creating a gloss finish is that excess steam which has not been absorbed by the paper condenses on cool surfaces of the adjacent structure of the calender stack. For example, the steam may condense on a steel calender roll, which will wet the paper as the steel roll contacts the paper. The extra moisture from the steel calender roll in addition to the moisture applied directly to the sheet from the steam applicators will affect the moisture distribution and hence the gloss finish and other physical properties of the paper. In addition, excess steam may condense on a cool portion of the paper surface where steam treatment is not intended, thereby affecting the gloss profile.

Moreover, steam which condenses on these cool surfaces forms water droplets which may drip on the paper as it passes through the calender stack, thereby affecting the desired properties of the paper. Also, since gloss formation is generally the final step in paper manufacturing, the application of excess steam can cause coating detachment of any previously applied water soluble coatings which then adhere to the calender roll.

In the past, various apparatuses have been used for steam applicators to distribute steam on paper sheets during calendering. An apparatus designed for applying steam to achieve cross-directional gloss control is disclosed in U.S. patent application Ser. No. 07/303,494 of Boissevain, et al., filed Jan. 27, 1989, now U.S. Pat. No. 4,964,311 entitled, Cross-Directional Steam Application Apparatus. The disclosed apparatus functions by discharging jets of steam through a plurality of bucket nozzles located along the length of a manifold pipe.

Gloss formation depends upon the amount of steam that can be absorbed by the paper. One technique for increasing the total amount of steam that can be absorbed is to apply the steam at several different locations during the calendering process. The present invention provides for the use of multiple steam applicators spaced at intervals from one another along the direction of sheet movement and placed adjacent to the calender stack. Although the use of multiple steam applicators permits a greater degree of gloss enhancement, there is a need for a controller for the multiple steam applicators.

SUMMARY OF THE INVENTION

An object of the present invention is to provide a method and apparatus for controlling multiple fluid applicators used to distribute fluid against a web. The applied fluid affects a variety of physical characteristics, however, for the sake of simplicity, the invention will be discussed as distributing steam against a web to control the gloss finish of a web.

In accordance with an example of the invention, these and other objects are achieved by measuring the degree of gloss at each cross-directional section of the web, computing the average gloss error by subtracting a predetermined average gloss value from an average of the cross-directional gloss measurements, adjusting the pressure of a plurality of steam applicators to minimize the gloss error, computing the individual gloss error of each cross-directional section by subtracting a predetermined gloss value from the gloss measurement for the section, and adjusting a plurality of steam valve openings to minimize the individual gloss error of each section.

Pursuant to an example in accordance with the invention, multiple steam applicators are used to distribute steam against a web during calendering. A primary steam applicator is located adjacent a side of the web to which steam is applied. The primary steam applicator has a manifold, a primary inlet valve, and a plurality of steam valves spaced along the primary manifold. Each steam valve regulates the steam flow distributed to a cross-directional section of the web. A secondary steam applicator is located adjacent the sam side of the web to which e steam is applied. The secondary steam applicator has a manifold, a secondary inlet valve, and a plurality of steam valves spaced along the secondary manifold.

Each steam valve regulates the steam flow distributed to a cross-directional section of the web.

A gloss sensor measures the gloss finish of the web. A computer means, responsive to the gloss sensor, computes a cross-directional gloss error by comparing the gloss measurement at each cross-directional section against a predetermined gloss value for that cross-directional section. A valve control means, responsive to the computer means, adjusts the primary and secondary steam applicator steam valves to minimize the cross-directional gloss error. The computer means also computes a machine-directional gloss error by comparing the average of the gloss measurements against a predetermined average gloss value. A steam pressure controller means, responsive to the computer means, adjusts the primary and secondary inlet valves of the steam applicators to minimize the machine-directional gloss error.

The gloss gauge monitors the gloss profile on the web surface at cross-directional sections of the web and generates a signal corresponding to the measured gloss. The signals from the gauge are sent to a computer which then calculates the average of the gloss measurements and compares it to a predetermined average gloss value to generate an average gloss error for the web. The average gloss error is then input into a conventional single variable control algorithm. The output of this algorithm is the total steam flow or change in total steam flow required to minimize the average gloss error. A flow/pressure conversion algorithm then converts the required total steam flow or change in total steam flow into a corresponding pressure required at a primary manifold. A secondary manifold pressure is obtained by a ratio controller which maintains the relative pressure between the primary and secondary manifold so that the relative steam flows are maintained at a constant value. A steam pressure controller then adjusts the total volume of the steam entering each manifold through corresponding separate inlet valves so that the desired average gloss value is obtained by minimizing the average gloss error of the web. A valve control device manipulates the entire set of valve openings of each manifold so that the sum of all the valve openings remains a constant value.

The amount of steam applied to each cross-directional section of the web surface is also controlled. First, the operator enters shape factors for each cross-directional section of the paper. The shape factors represent the gloss deviation that a particular section might have from the other sections. The computer calculates the average of the shape factors and subtracts the average of all of the shape factors from the individual shape factors for each section. Next, the computer adds the average of the gloss measurements to the shape factors for each section to obtain gloss targets for each section. Finally, gloss measurements are subtracted from the computed gloss targets to give the gloss errors for each cross-directional section. This array of gloss errors is then input into an array of conventional single variable control algorithms which then output an array of initial valve positions or changes to an array of initial valve positions. The computer obtains the desired valve positions for each section by adding a constant to each of the initial valve positions such that the sum of all valve openings remains a constant value. The valve control device then manipulates the entire set of valve openings of each manifold so that the gloss error of each section is minimized. The control system decouples a cross-directional (CD) control algorithm from the pressure variations caused by a machine-directional (MD) control algorithm by retuning the cross-directional process gain according to the current primary manifold pressure to yield an accurate apparent process gain.

The invention achieves a greater degree of gloss enhancement by directing steam at several different locations during the calendering process. The invention increases the amount of steam applied without undesired condensate drippage by spacing the steam applicators at intervals from one another along the direction of sheet movement. The invention achieves these advantages by providing a simple and efficient method of controlling the multiple steam applicators so that they act as a single unit.

BRIEF DESCRIPTION OF THE DRAWINGS

The foregoing objects, features and advantages of the invention will become more apparent from the following detailed description of the preferred embodiments taken in conjunction with the accompanying drawings, in which.

DESCRIPTION OF THE PREFERRED EMBODIMENTS

The following description is the best contemplated mode of carrying out the invention. This description is made for the purpose of illustrating the general principles of the invention and should not be taken in a limiting sense. The scope of the invention is best determined by reference to the appended claims. In the accompanying drawings, like numerals designate like parts in the several figures.

Figure 1:
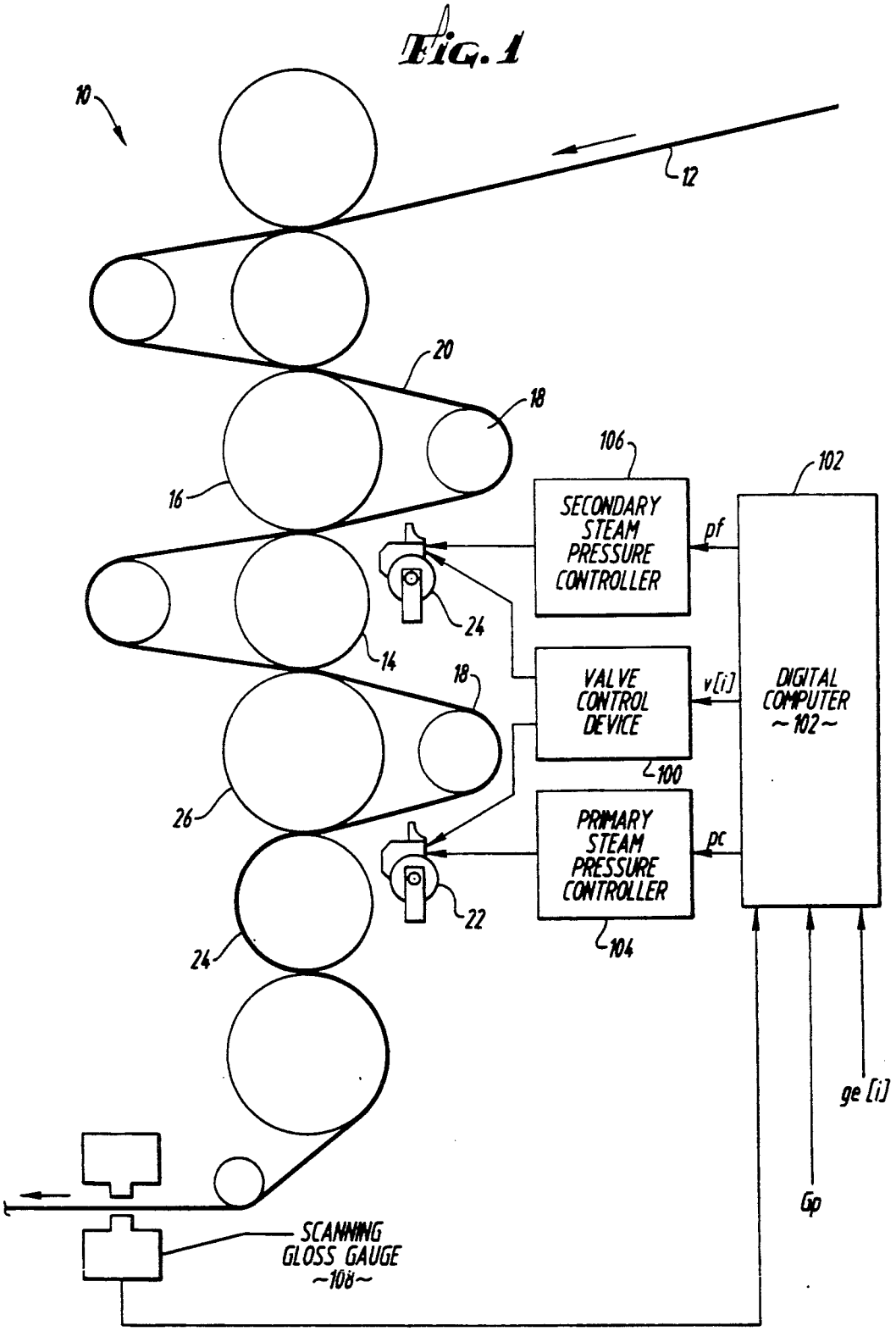
FIG. 1 is a side elevation view showing a calender roll stack in which the present invention may be used to steam treat the surface of a web.

FIG. 1 shows a calender roll stack 10 suitable for pressing a web such as paper 12 to obtain desired physical characteristics. For simplicity, the invention will be described with reference to paper as the web and gloss as the desired physical characteristic. However, the invention can apply to web materials other than paper and desired physical characteristics other than gloss. The calender roll stack 10 includes at least one roll having a highly polished hard surface. Typically, the polished surface is made of steel. This polished roll will be referred to as steel roll 14. Provided adjacent to the steel roll 14 is a roll having a somewhat resilient surface, referred to as soft roll 16. One or more steel rolls 14 and soft rolls 16 may be arranged in a vertical stack wherein the paper 12 passes between the rolls in a path of a general "S" configuration. Idler rolls 18 may be provided on the sides of the stack 10 to facilitate the movement of the paper 12.

Gloss is created on the surface of the paper 12 as the paper passes between the steel roll 28 and its adjacent soft roll 26. Gloss is created only on the surface 20 of the paper 12 which has been treated with steam. A primary steam applicator 22 of the present invention is positioned adjacent to this surface 20 of the paper 12 at a location upstream of the steel roll 28 (with reference to the direction of travel of the paper). The primary steam applicator 22 directs steam at the paper surface 20 as it approaches the steel roll 28. The steam applicator 22 is preferably positioned leaving an approximately three-inch gap between it and the paper surface 20. The steam emitted by the primary steam applicator 22 softens the surface 20 of the paper 12 by action of the heat and moisture associated with the steam before the paper 12 is pressed by the steel roll 28 against the soft roll 26. A gloss finish is formed o the surface 20 of the paper 12 which has been treated with steam. To enhance the gloss finish on the same surface 20 of the paper 12, a secondary steam applicator 24 working in conjunction with a second steel roll 14 and a second soft roll 16 is employed in the same manner.

Figure 2:
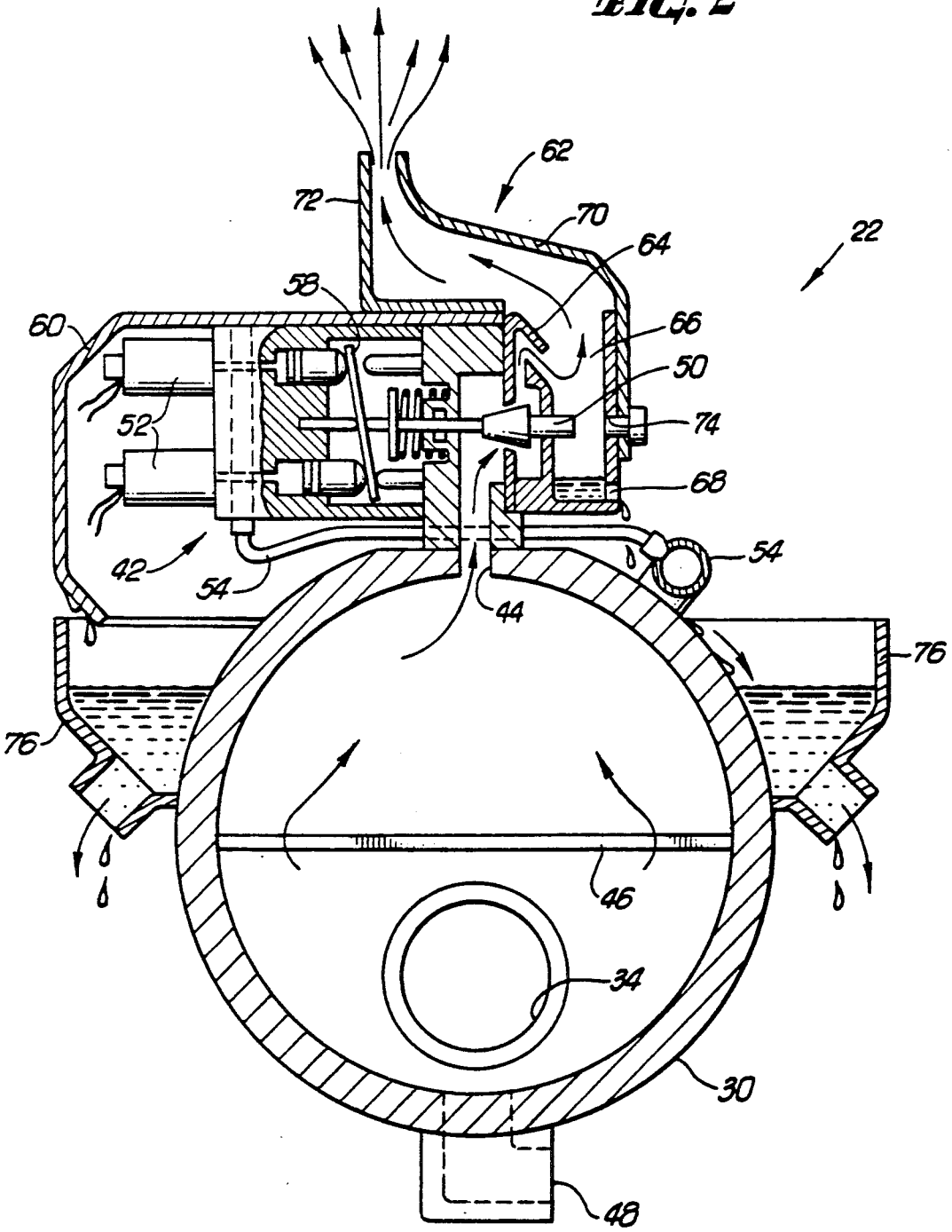
FIG. 2 is a side elevation view, in cross-section, of a steam applicator used by the present invention, illustrating a particular internal structure of a steam manifold, a valve and a bucket nozzle.

The structure of the primary steam applicator 22, which is identical to the secondary steam applicator 24, is described with reference to FIGS. 2 and 3. FIG. 2 is a cross-sectional view of an embodiment of the primary steam applicator 22. The primary steam applicator 22 comprises a steam manifold 30 fabricated from a pipe having a length generally spanning the paper width to which steam will be applied (i.e., in the cross-direction). The steam manifold 30 is preferably made from corrosion-resistant material such as stainless steel. It has been determined that a six-inch inside diameter stainless steel pipe having a 3/16 inch wall offers adequate structural rigidity. Such pipe is readily available at relatively low cost.

Figure 3:
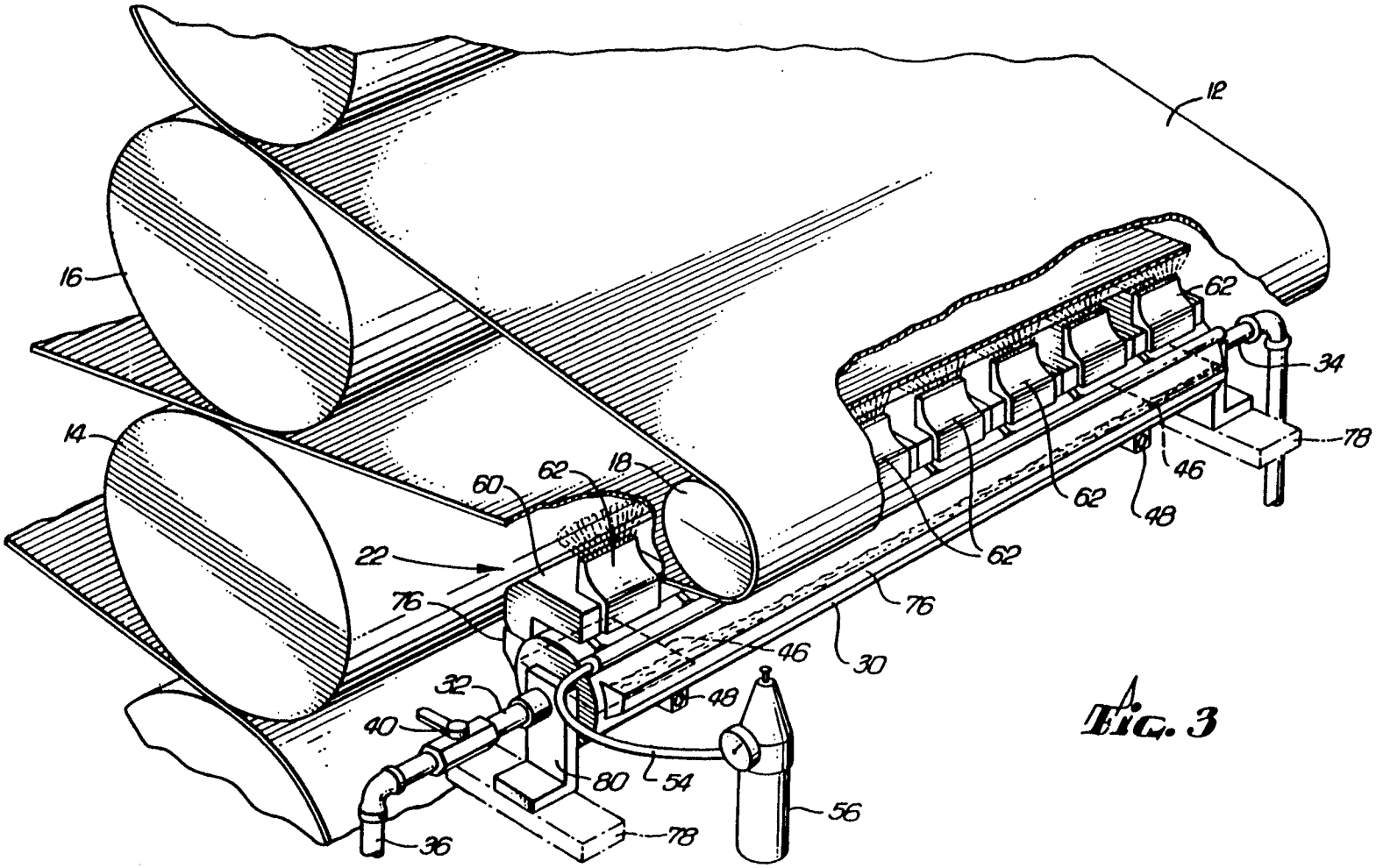
FIG. 3 is a perspective view of a steam applicator located adjacent to a calender roll stack in which a portion of the idler roll and of the web are cut away to show the features of the steam applicator.

As shown in FIG. 3, the steam manifold 30 is provided with an inlet pipe 32 at one end and an outlet pipe 34 at its opposite end. Suitable inlet and outlet pipes 32 and 34 have a diameter which is smaller than the diameter of the steam manifold 30 (for example, two inches). Steam, preferably in a saturated state at 1–15 psig pressure, is delivered into the inlet pipe 32 by a main supply pipe 36. The inlet pipe 32 is provided with a pressure control valve 40 and a pressure sensor (not shown). Steam will enter the steam manifold 30 only if the pressure control valve 40 is at least partially open. Each individual steam manifold 30 is supplied with steam independently from the other steam manifolds. Furthermore, the steam pressure valve 40 allows control over the volume of steam entering the steam manifold 30. Thus, the amount of steam applied by steam manifold 30 can be regulated, thereby increasing the control over the gloss distribution. Also, gloss may be created in increments by use of multiple steam applicators.

As shown in FIG. 2, a plurality of steam valves 42 are mounted to the top of the steam manifold 30. Each steam valve 42 is mounted into an orifice having the shape of a slot 44 provided in the top of the steam manifold 30. Pressurized steam enters the steam valves 42 from the steam manifold 30 through the slots 44. Each slot 44 is approximately 1.5 to 2 inches long and has a width of approximately ¼ inch to allow an adequate volume of steam to enter the valves 42. The slots 44 are preferably distributed in even intervals along the entire length of the steam manifold 30. Accordingly, the number of slots 44 with steam valves 42 provided on a particular steam manifold 30 depends upon the length of the pipe. Resolution of the control over the cross-directional gloss profile is increased as the distance between the slots 44 and associated steam valves 42 is decreased. To achieve optimum control over the cross-directional gloss profile, the distance between slots 44 is preferably only a few inches (typically about three inches).

A baffle 46 is mounted inside the steam manifold 30 adjacent the inlet pipe 32 and between the inlet pipe 32 and the steam valves 42. The baffle 46 prevents potential condensate from entering the valves 42 located near the inlet pipe 32. The baffle 46 spans the diameter of the steam manifold 30 and is preferably approximately ten inches long. A second baffle may be provided inside the steam manifold 30 adjacent its outlet pipe 34 and between the outlet pipe 34 and the valves 42 to allow for reverse installation (i.e., flowing into the steam manifold 30 through outlet pipe 34). Condensate present in steam entering the steam manifold 30 is deflected by the baffle 46 and collects at the bottom of the pipe, where it is drained from the steam manifold 30 through at least one condensate drain orifice 48 provided in the steam manifold pipe 30 (see FIG. 3).

As shown in FIG. 2, each valve 42 of the present invention may be a 16-position digital steam valve as disclosed in more detail in the commonly assigned, co-pending U.S. patent application Ser. No. 07/303,450 of Mathew G. Boissevain, filed on Jan. 27, 1989, allowed on May 4, 1990, and entitled Digitally Incremented Linear Actuator. This patent application is incorporated herein by reference. In general, the 16-position digital steam valve disclosed comprises a poppet valve 50 actuated by four solenoid valves 52 (two of which are not shown) such as the HS-LS Series Solenoid Valves commercially available from Numatics, Inc. (Michigan). Air flows to the solenoid valves 52 from air hose 54. The air hose 54, mounted adjacent to the steam valve 42, channels air from an air regulator 56 to the air inlet of each solenoid valve 52 at a pressure of approximately 40 psig for activation of the associated pistons 53 associated with the solenoid valves 52. Once a solenoid valve 52 is activated, air is admitted behind the associated piston 53, which is forced against a lever 58, which in turn contacts the poppet valve 50. The number of solenoid valves 52 activated determines the position of the lever 58 and thereby the position of the poppet valve 50. The position of the poppet valve 50 in turn determines the volume of steam flowing through the nozzle 62 to the paper.

In the illustrated embodiment, the dimensions of the poppet valve 50 and bucket nozzle 62 are such that, when the poppet valve 50 is fully open, the nozzle 62 will discharge approximately 15–25 lbs/hour of steam per cross-directional foot of sheet. Moreover, this "lazy steam" exiting the nozzle 62 in this embodiment has little or no velocity by the time it reaches the sheet. Because of the limited velocity and volume of steam exiting the nozzle 62, the steam applicator 22 avoids the necessity of a vacuum device for removing excess steam. In fact, when such low steam volume and velocity are used, the condensate may form by the time it contacts the paper 12. Each valve 42 is provided with a cover 60 to protect the valves 42 from exposure to condensate which may form on the steam applicator 22.

To convert the high velocity steam jetted from each valve 42 into low velocity, "lazy steam," each valve 42 is provided with a bucket nozzle 62. Bucket nozzle 62 is mounted to the cover 60. The bucket nozzle 62 comprises a cane-shaped deflector plate 64 mounted adjacent the poppet valve 50 and a container 66 (preferably having the shape of a bucket). The container 66 includes at least one drain hole 68 in its bottom and a nozzle portion. For convenience, the container 66 of the bucket nozzle 62 also includes a small orifice 74 to allow access to the poppet valve 50 for manual screwdriver adjustments. Pressurized steam entering the bucket nozzle 62 through the poppet valve 50 jets up against the deflector plate 64, which redirects the steam's flow to the bottom of the container 66. Condensate present in the steam collects at the bottom of the container 66 and then drains out the drain holes 68. The steam, on the other hand, rises to the top of the container 66 and against a curved deflector 70 which, in conjunction with an off-set deflector 72, forms the nozzle portion of the bucket nozzle 62. The deflectors 64, 70 and 72 cooperate to remove substantially all condensate from and decrease the velocity of the steam. The "lazy steam" is thereby directed against the paper 12 by the bucket nozzle 62 at a relatively low velocity.

Condensate forming on the parts of the primary steam applicator 22, or drained from the container 66 of the bucket nozzle 62, is directed away from the paper 12 by a pair of gutters 76 provided on the steam manifold 30. The gutters 76 are mounted, one on each side, along the entire length of the steam manifold 30. The gutters 76, as well as the bucket nozzle 62 and baffle 46, are preferably made of corrosion-resistant material such as stainless steel.

As shown in FIG. 3, the steam applicator 22 may be mounted directly to a mounting base 78 provided on the calender stack 10 using a yoke 80. The steam applicator 22 may be incorporated into any calender stack since it functions equally well if mounted at a variety of angles relative to the paper 12 about the axis of the steam manifold 30. This provides great flexibility as well as a high degree of control over steam distribution at a low cost.

The invention controls gloss formation by controlling the amount of steam applied to the paper by multiple steam applicators. The amount of gloss change observed in paper has been shown to be approximately proportional to the total amount of steam applied to the paper as follows:

$$Gt = Kfg \cdot Wt \quad (1)$$

$Gt$ = amount of gloss change
$Wt$ = total steam flow applied to moving paper
$Kfg$ = gloss to flow gain constant Equation (1) represents the static relationship between total steam applied to the paper and gloss enhancement. However, gloss does not change instantaneously when the steam is applied. The gloss change can be approximated by a first order dynamic system. Nevertheless, this relationship provides the basis for a control scheme which controls the degree of gloss of he paper by manipulating the total steam flow Wt applied to the paper.

Although the invention can be used to control any number of steam applicators, the discussion will be limited to the two steam applicators shown in FIG. 1, which will be referred to as primary steam applicator 22 and secondary steam applicator 24. Each of the steam applicators 22, 24 include a steam manifold 30 as shown in FIG. 3, which spans the width of the paper 12 in the cross-direction. The paper 12 has N cross-directional sections. Each steam manifold 30 supports N number of steam valves 42. Each steam valve 42 controls the amount of steam applied to a cross-directional section of the paper 12.

As shown in FIG. 1, a digital computer 102 executes a program which sends control signals to a valve control device 100. The valve control device 100 adjusts each steam valve 42 position v[i], that is, the degree to which the valve is open for each of the cross-directional sections: i=1, . . . N of the paper in accordance with control signals from the computer 102. The valve control device 100 maintains t he same valve position v[i] at each section for both steam applicators 22, 24. The steam valves 42 are designed so that the valve positions v[i] are linearly related to the valve flow coefficient Cv.

The computer 102 also calculates the required primary and secondary manifold pressures pc, pf and sends corresponding control signals to steam pressure controllers 104, 106. The primary steam pressure controller 104 adjusts an inlet valve to the primary manifold, thereby setting the primary manifold pressure pc. Similarly, the secondary steam pressure controller 106 adjusts a separate inlet valve to the secondary manifold, thereby setting the secondary manifold pressure pf.

A scanning gloss gauge 108 located downstream from the steam applicators 22, 24 monitors the gloss of the paper surface 20. The gloss gauge 108 provides an electrical signal corresponding to the degree of gloss of the paper surface 20. An analog-to-digital converter converts the analog electrical signal to a digital floating point value which is stored in the memory of computer 102. The computer 102 also coordinates a series of measurements as the gloss gauge 108 scans over the cross-directional width of the paper 12. The array of measured gloss values gm[i], i=1, . . . N are stored in the memory of computer 102. Each value in this array represents a measurement of the gloss at a cross-directional section of the paper 12. With this configuration, changing the ith valve position v[i] of the primary and secondary steam applicators 22, 24 affects the gloss measurement at the ith section of the paper 12.

Figure 4:
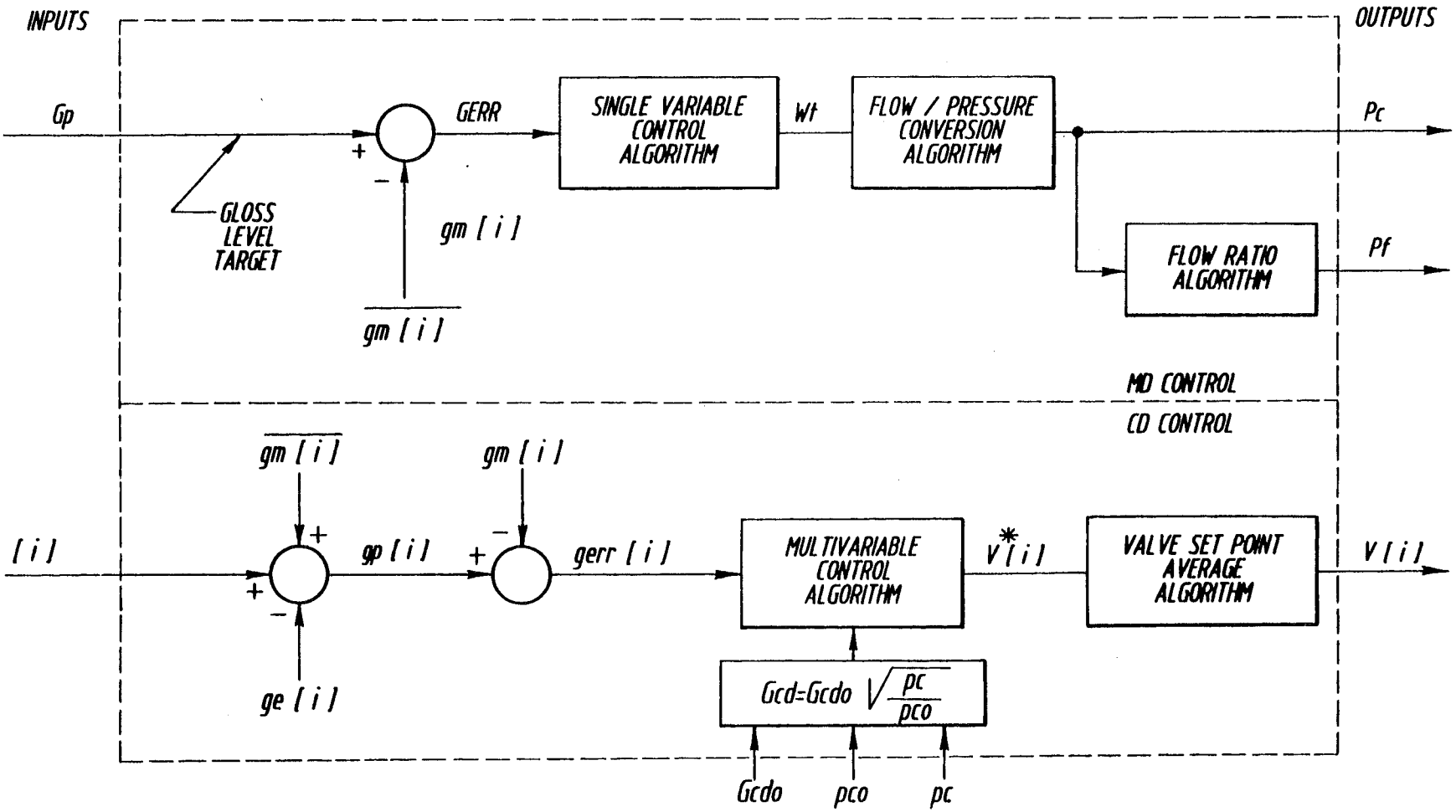
FIG. 4 is a block diagram showing a computer program executed by a digital computer for controlling the multiple steam applicators of the present invention.

FIG. 4 shows a block diagram of a control program which is executed by the computer 102 to control the multiple steam applicators. The dotted line indicates the boundaries of the program. Anything inside the boundary indicates a calculation being performed by the computer 102. Inputs and outputs to the control program are shown as crossing to the inside or outside of this boundary, respectively. Two control algorithms are executed. The first algorithm controls the average gloss across the cross-directional width of the paper 12 and is referred to as MD control.

The MD control algorithm is described in the following sequence of steps. First, the operator enters a desired average gloss value Gp into the computer 102 The gloss gauge 108 scans the width of the paper 12 and takes gloss measurements gm[i] at each cross-directional section and sends signals corresponding to the measurements to the computer 102. Next, the computer 102 calculates the average of the gloss measurements gm[i]. The average gloss measurement gm[i] is then subtracted from the desired average gloss value Gp to form the average gloss error Gerr as follows:

$$Gerr = Gp - \overline{gm[i]} \quad (2)$$

This average gloss error Gerr is then input into a conventional single variable control algorithm, preferably the Measurex Lambda tuned control algorithm which is described below. Another suitable conventional control algorithm is referred to as the proportional-integral-derivative (PID) algorithm. The output of either control algorithm is used to determine the required value for the total steam flow Wt. If the average gloss measurement $\overline{gm[i]}$ is greater than the desired average gloss value Gp, then the total steam flow Wt decreases. Conversely, if the average gloss measurement gm[i] less than desired average gloss value Gp, then the total steam flow Wt increases. The following describes the implementation of a controller algorithm used in a preferred embodiment of the invention.

In analyzing and designing digital control, a convenient transformation method known as the z-transform is used. This is used because it converts complicated differential and difference equations into expressions that can be handled by simple algebra. For example $z^{-1}$ represents a unit delay, i.e., if you have a signal U(t), then its value one sampling period (T) ago is U(t−T) or $z^{-1}\times U(z)$. If the delay is (N) periods ago, i.e., NT for time, then it is represented by U(t−NT) or $z^{-N}\times U(z)$. Similarly if a process is made of gain, k, and a first order time constant, Tc, then it has the z-transform of:

$$G(z) = \frac{k(1 - e^{-T/Tc})z^{-1}}{1 - e^{-T/Tc}z^{-1}} = \frac{kLz^{-1}}{1 - (1 - L)z^{-1}} \text{ if } L = 1 - e^{-T/Tc} \quad (3)$$

This mathematical representation can be used to show that when a step change in input is applied, it will result in an exponential response related to the time constant, Tc.

If the process is to include a dead time which is N times the sampling or control period, T, then the process would be represented by the following z-transform:

$$\frac{kLz^{-(N+1)}}{1 - (1 - L)z^{-1}} \quad (4)$$

This is done by multiplying Equation (3) by $z^{-N}$.

DERIVATION OF THE MEASUREX LAMBDA TUNED CONTROL ALGORITHM

Figure 5:
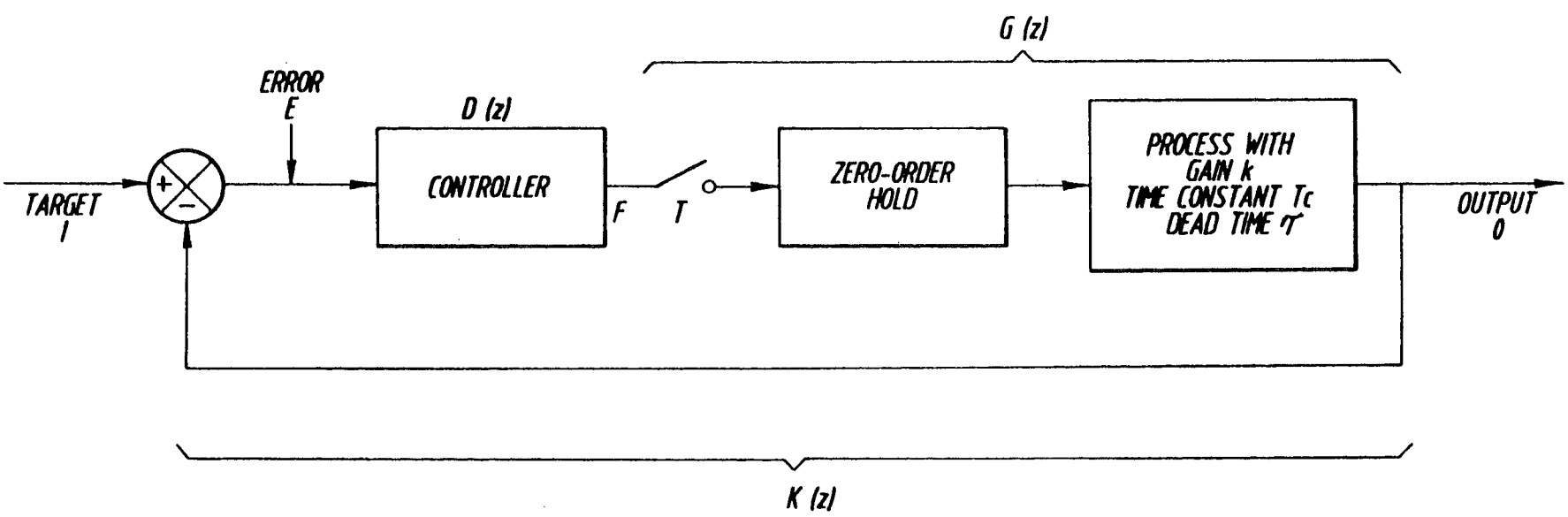
FIG. 5 is a block diagram showing use of the Measurex lambda tuned control algorithm.

The Measurex lambda tuned control algorithm D(z) is illustrated in FIG. 5. Given (1) a process described by a gain, k, a time constant, Tc, and a dead time, $\tau$=NT, and (2) a desired closed loop response K(z), then (3) the control algorithm which accomplishes this can be found by solving for D(z).

These three points can be translated mathematically to the following:

1. As described in Equation (4), a process with gain, k, a time constant, $T_c$, and dead time, $\tau$=NT, is represented by the following z-transform equation:

$$G(z) = \frac{kLz^{-(N+1)}}{1 - (1 - L)z^{-1}} \quad (5)$$

2. If the desired response K(z) is an exponential response having the closed loop time constant 1/λ, then it is represented by:

$$K(z) = \frac{Qz^{-(N+1)}}{1 - (1 - Q)z^{-1}} \quad (6)$$

where $Q = 1 - e^{-\lambda T}$

3. Design the controller D(z) and derive the control algorithm.

By using algebra we can write the following equations:

$$E(z) = I(z) - O(z) \quad (7)$$

$$O(z) = D(z)G(z)E(z) \quad (8)$$

The desired closed loop response is give by:

$$K(z) = O(z)/I(z) \quad (9)$$

where
I(z)=target
O(z)=output, and
E(z)=error.

By combining the above three equations and solving for D(z), we get:

$$D(z) = \frac{K(z)}{1 - K(z)} \times \frac{1}{G(z)} \quad (10)$$

By substituting G(z) and K(z) from Equations (5) and (6), the digital controller D(z) is found to be:

$$D(z) = \frac{\text{CONTROLLER OUTPUT, } F(z)}{\text{CONTROLLER INPUT, } E(z)} = \frac{Q}{kL}\,\frac{1 - (1 - L)z^{-1}}{1 - (1 - Q)z^{-1} - Q \times z^{-(N+1)}} \quad (11)$$

Before utilizing this equation any further we have to introduce two types of algorithms: positional and incremental. The algorithm to be derived from equation (11) above is a positional algorithm since the controller will determine the absolute value of its output each control period. If we were, for example, making outputs to a control valve to move it from 50 to 60 percent in four outputs, a positional algorithm would have an output sequence of 50, 53, 55, 57, and 60 percent. On the other hand, an incremental algorithm is one which issues a sequence of changes to be added to whatever the valve position was. Therefore the output sequence in this case would be +3, +2, +2, +3 percent. This type of algorithm is more commonly used in direct digital control.

Mathematically, using the z-transform to convert a positional algorithm to an incremental algorithm would require multiplying Equation (11) by $(1-z^{-1})$. Therefore, $$\Delta D(z) = \frac{\text{CONTROLLER OUTPUT CHANGE } C(z)}{\text{CONTROLLER INPUT } E(z)} = \frac{Q}{kL}\,\frac{[1 - (1 - L)z^{-1}] \times [1 - z^{-1}]}{1 - (1 - Q)z^{-1} - Qz^{-(N+1)}} \quad (12)$$

$$\frac{C(z)}{E(z)} = \frac{Q}{kL}\,\frac{1 - (1 - L)z^{-1}}{1 + Qz^{-1} + Qz^{-2} \ldots + Qz^{-N}} \quad (13)$$

By cross-multiplication we get as follows $$[1 + Qz^{-1} + Qz^{-2} + \ldots + Qz^{-N}]C(z) = \frac{Q}{kL}[1 - (1 - L)z^{-1}]E(z) \quad (14)$$

The above equation can be converted to a time basis by using the following equivalences:

$$C(z) - C(nT) = \text{output at time } nT. \quad (15)$$
$$E(z) - E(nT) = \text{input at time } nT.$$
$$z^{-1}C(z) - C(nT - T) = \text{previous output at time } nT - T \text{ etc.}$$

Therefore we have:

$$C(nT) = Q[C(nT - T) + C(nT - 2T) + \ldots C(nT - NT)] + \frac{Q}{kL}[e(nT) - (1 - L) \times e(nT - T)] \quad (16)$$

where
C(nT−T)=previous output move,
C(nT−NT)=output move NT periods back,
E(nT)=present input, and
e(nT−T)=previous input.

The control algorithm, as shown by equation (16), is used to produce a desired change in the total stream flow C(nT) based on previous desired changes and the current and previous gloss errors E(nt).

$$Wt = Wt + C(nT)$$

The invention controls the total stream flow Wt by directly controlling the primary manifold pressure pc. The total steam flow Wt can be related to the primary manifold pressure pc by the following derivation. First, when the manifold pressures pc, pf are operated in a low range (1–15 psig), hydrostatic fluid flow equations may be used to approximate the steam flow through the individual valves 42 to the manifold pressures of the steam applicator 22, 24. The equations below can be used for a valve 42 whose flow coefficient Cv is approximately proportional to the valve opening position:

$$wc[i] = A*Cv*v[i]*[pc**0.5];\ i = 1, \ldots N \quad (17)$$
$$wf[i] = A*Cv*v[i]*[pf**0.5];\ i = 1, \ldots N \quad (18)$$

$Wc[i]$ = steam flow from the primary steam applicator at the $i$th section of the paper $Wf[i]$ = steam flow from the secondary steam applicator at the $i$th section of the paper $A$ = a constant dependent on the specific volume and temperature of the steam $Cv$ = a constant flow coefficient dependent on the shape and the size of the valve opening ($Cv$ is defined only for $v[i] = 1.0$, that is when the valve is fully open)

$v[i]$ = valve opening position at the ith section of the paper (0.01–1.0)

$pc$ = primary manifold pressure
$pf$ = secondary manifold pressure

The total steam flow from the primary steam applicator Wc and from the secondary steam applicator Wf may then be described as follows:

$$Wc = A*N*Cv*\overline{v[i]} * [pc**0.5] \quad (19)$$
$$Wf = A*N*Cv*\overline{v[i]} * [pf**0.5] \quad (20)$$

$Wc$ = total steam flow from the primary steam applicator $Wf$ = total steam flow from the secondary steam applicator $A$ = a constant dependent on specific volume and temperature of steam $v[i]$ = average valve opening position across all sections of the paper $Cv$ = a constant flow coefficient dependent on the shape and size of valve opening ($Cv$ is defined only for $v[i] = 1.0$, that is, when valve is fully open)

$N$ = number of cross-directional sections across the paper

The steam flow ratio Fr represents the ratio of the total steam flow from the secondary to primary steam applicators as follows:

$$Fr = Wf/Wc \quad (21)$$

If $\overline{v[i]}$ is maintained at a constant value, then equations (19), (20) and (21) can be combined to give an equation for relating the secondary manifold pressure pf relative to the primary manifold pressure pc. This equation is referred to a the flow ratio algorithm:

$$pf = [(Fr)**2]*pc \quad (22)$$

Equation (22) specifies the relative pressure in the steam manifolds such that the steam flow ratio Fr will be maintained between the two steam applicators 22, 24. Here, Fr and pc are inputs to the relationship and pf is the output. If a ratio controller using equation (22) is implemented for controlling the ratio of steam flow delivered by the primary and secondary steam applicators 22, 24, then it can be shown by equations (19), (20) and (21) that the total steam flow Wt is directly proportional to the square root of the primary manifold pressure pc as follows:

$$\begin{aligned} Wt &= Wc + W \\ &= A*Cv*N*\overline{v[i]}*(1 + Fr)*[(pc)**0.5] \\ &= Kpf*[(pc)**0.5] \end{aligned} \quad (23)$$

$Wt$ = total steam flow delivered by the primary and secondary steam applicators $Kpf$ = flow to pressure gain constant Equation (23) is used to form the basis of an algorithm which will be referred to as the flow/pressure conversion algorithm Equation (23) is used to determine a new value for the primary manifold pressure pc depending on the required value for total steam flow Wt. Equation (23) indicates that if $\overline{v[i]}$ and the steam flow ratio Fr are held constant and a ratio controller maintains the pressure pf as a function of pc, then the total steam flow Wt can be adjusted by directly manipulating only the primary manifold pressure pc.

In many practical cases, however, only the change in primary manifold pressure pc as a function of the change in total steam flow Wt is desired. Such a case exists when an incremental control algorithm such as the Measurex lambda tuned controller is used. In this case, the output of the control algorithm is the change in steam flow required to reduce the average gloss error Gerr and the output hardware (for example, steam pressure controller 104) is designed to incrementally change the primary manifold pressure pc. Equation (23) does not yield this result directly.

In order to handle this situation, a more convenient flow/pressure conversion relationship for equation (23) is obtained by using a Taylor series expansion to express pc as a function of the current operating steam flow Wt. This expansion may then be used to generate a relationship which gives the change in the primary manifold pressure dpc required to effect a desired change in total steam flow Dwt.

$$dpc = (2/Kpf)*[pc(0)**0.5]*Dwt + [Dwt/Kpf)**2] \quad (24)$$

$dpc$ = required change in primary manifold pressure to produce the desired steam flow change $pc(0)$ = initial primary manifold pressure $Dwt$ = desired change in total steam flow which is the output from incremental controller Equation (24) is valid for the range $Dwt > -Kpf\sqrt{pc(0)}$. Equation (24) transforms the desired change in the total steam flow Dwt into the required change in the primary manifold pressure dpc when the primary manifold pressure pc and steam flow Wt are related as shown in equation (23). Equation (24) is a suitable alternative relationship to use instead of equation (23).

The pressure to flow constant Kpf in equations (23) and (24) may be determined experimentally. First the steam flow ratio Fr is set at a desired value, such as between the dimensionless ratio 0.25–1.0. Second, the average valve position v[i] for the steam applicator 22 is then set at a value, for example 0.50, which will be maintained during operation. Finally, the total steam flow entering the steam applicators 22, 24 (which is equal to the total steam flow Wt applied to the paper by conservation of mass) is measured by a steam flow transducer and the corresponding primary manifold pressure pc is measured. Kpf is then found from equation (23) by substituting the measured values for Wt and pc.

Once a new value has been calculated for primary manifold pressure pc by either equation (23) or (24), then the flow ratio relationship (22) is used to determine a new value for the secondary manifold pressure pf in terms of the primary manifold pressure pc. Once new values for both pc and pf have been calculated, they are output to the primary and secondary pressure controllers 104, 106 which then change the steam manifold pressures pc, pf in the steam applicators 22, 24.

The CD control algorithm is described in the following sequence of steps. First, the desired gloss profile is obtained by the operator entering a shape factor ge[i] for each cross-directional section of the paper 12. The shape factor ge[i] represents the gloss deviation the ith section might have from the other sections. If a uniform gloss profile is desired, the shape factor ge[i] will be the same for each section. The computer 102 then calculates the average of the shape factors ge[i] and subtracts from $\overline{ge[i]}$ for each section. Next, the computer adds the average of the gloss measurements $\overline{gm[i]}$ for each section. This generates an array of desired gloss targets gp[i] which includes the shape entered by the operator with a reference value equal to the average gloss measurement $\overline{gm[i]}$:

$$gp[i] = ge[i] - \overline{ge[i]} + \overline{gm[i]} \quad (25)$$

The gloss measurements gm[i] are then subtracted from the computed gloss targets gp[i] to give the gloss error gerr[i] at each section of the paper:

$$gerr[i] = gp[i] - gm[i] \quad (26)$$

The array of gloss errors gerr[i] are then input into an array of conventional single variable control algorithms such as a PID or a Measurex lambda tuned control algorithm. The output of this array of algorithms is used to update an array of initial valve positions v[i]*. The computer 102 obtains v[i] by adding a constant to each of the initial valve positions v[i]* in order to maintain $\overline{v[i]}$ at some constant value. A preferred value for the average valve position $\overline{v[i]}$ is 0.5, or setting the average of all the steam valves 50 half open. This value maximizes the control range of the steam applicators 22, 24. After the valve positions v[i] are calculated, they are output to the valve control device 100 which physically manipulates the steam valves 42. If the measured gloss at a particular section gm[i] is above the desired target gp[i], then the control algorithm will send a signal to the valve control device 100 which decreases the valve position v[i] for the corresponding section so as to decrease the applied steam and thereby lower the gloss. Conversely, if the measured gloss gm[i] in a particular section is below the desired target gp[i], the valve position v[i] for that section is increased. Because the CD control algorithm does not change the average valve position v[i ], the aggregate Cv for the steam applicators 22 and 24 remains constant. This implies that for a given primary manifold pressure pc the CD control algorithm does not change the total amount of steam Wt applied to the paper 12. The steam is simply redistributed to eliminate the gloss cross-directional profile error.

As mentioned earlier, the MD control algorithm changes the gloss level by changing the total steam Wt applied to the paper 12 by directly adjusting the primary manifold pressure pc. However, when the primary manifold pressure pc is adjusted, it will affect the amount of gloss change that will occur for a given change in the valve position v[i]. If a Measurex lambda tuned controller is used, then the following technique can be used to retune the CD process gain directly. The change in gloss due to a change in valve position is referred to as the CD process gain Gcd. The CD process gain Gcd is an input for the array of single variable control algorithms shown in FIG. 4. In order to decouple the CD control algorithm from the pressure variations caused by the MD control algorithm, the CD process gain Gcd must be retuned according to the current primary manifold pressure pc to yield a retuned value for process gain Gcd:

$$Gcd = Gcdo*[(pc/pco)**0.5] \quad (27)$$

$Gcd$ = updated $CD$ process gain used by $CD$ control algorithms $Gcdo$ = $CD$ process gain measured at nominal primary manifold pressure $pc$ = current primary manifold pressure $pco$ = nominal manifold pressure used when calculating the nominal $CD$ process gain Typically, an on-site engineer will determine the nominal CD process gain Gcdo by first setting the nominal primary manifold pressure pco equal to a pressure of about 2–3 psi. Next, the valve position v[i] will be adjusted by a known amount and the change in g[i] measured. The calculated value of Gcdo and the predetermined value of pco and the current primary manifold pressure pc are then used to calculate the retuned CD process gain Gcd. Gcd is then used as an input to decouple the array of CD control algorithms from the pressure variations caused by the MD control algorithm.

It should be pointed out that this scheme is completely compatible with the use of a non-sectionalized steam applicator. In this case, the CD control algorithm output is sent to the sectionalized steam applicator as previously described. Non-sectionalized steam applicators can be tied together with the sectionalized applicators via the flow ratio of equation (22). The MD control algorithm then manipulates pressure in all steam applicators (sectionalized and non-sectionalized). In this "mixed" configuration, the MD control algorithm will still be adjusting the total amount of steam being delivered to the product. The CD control algorithm will profile that portion of the steam being provided by the sectionalized units. This is not the optimum configuration from a control standpoint because the CD control range is sacrificed (only part of the steam is available for profiling). However, it may be the most desirable configuration for some installations because of the significant economy of using non-sectionalized over sectionalized steam applicators. This configuration seems most useful for supercalender systems running latex based coatings, as these coatings are far less susceptible to detachment (picking).

We claim:

1. An apparatus for controlling and in combination with a plurality of fluid applicators spaced from one another in a machine-direction and located adjacent a side of a web, each fluid applicator having a manifold, an inlet valve and a plurality of fluid valves spaced along the manifold, each fluid valve regulating a fluid flow distributed to a cross-directional section of the web, comprising:

a sensor for measuring a physical characteristic at each cross-directional section of the web;

computer means, in communication with and responsive to the sensor, structured for computing a cross-directional error by comparing the measurement at each cross-directional section against a predetermined value for the cross-directional section and for computing a machine-directional error by comparing the average of the measurements against a predetermined average value, wherein the computer means includes a ratio controller that maintains the relative pressure of the plurality of fluid applicators so that the relative fluid flow from the fluid applicators is maintained at a constant value;

valve control means, responsive to the computer means, for adjusting the fluid valves to minimize the cross-directional error, without substantially changing the value of the machine-directional error; and fluid pressure controller means, responsive to the computer means, for adjusting the inlet valves to minimize the machine-directional error.

2. The apparatus of claim 1, further comprising a scanning means for transporting the physical characteristic sensor back and forth in the cross-direction across the web.

3. The apparatus of claim 1, wherein the physical characteristic is the gloss finish of the web.

4. The apparatus of claim 1, wherein each inlet valve adjusts the total amount of fluid entering each associated manifold.

5. The apparatus of claim 1, wherein the valve control means manipulates the fluid valves of each manifold so that the sum of all fluid valve openings remains a constant value.

6. The apparatus of claim 1, wherein the computer means further includes a decoupling means for decoupling the computation of cross-directional error from the computation of machine-directional error.

7. A system of multiple steam applicators used to distribute steam against a web during calendering, comprising:

a primary steam applicator located adjacent a side of the web to which steam is applied, the primary steam applicator having a manifold, a primary inlet valve, and a plurality of steam valves spaced along the primary manifold, each steam valve regulating a steam flow distributed to a cross-directional section of the web;

a secondary steam applicator spaced from the primary steam applicator in a machine-direction and located adjacent the side of the web to which steam is applied, the secondary steam applicator having a manifold, a secondary inlet valve, and a plurality of steam valves spaced along the secondary manifold, each steam valve regulating a steam flow distributed to a cross-directional section of the web;

a gloss sensor for measuring the gloss finish of the web;

computer means, in communication with and responsive to the gloss sensor, structured for computing a cross-directional gloss error by comparing the gloss measurement at each cross-directional section against a predetermined gloss value for the cross-directional section and for computing a machine-directional gloss error by comparing the average of the gloss measurements against a predetermined average gloss value;

valve control means, responsive to the computer means, for adjusting the primary and secondary steam applicator steam valves to minimize the cross-directional gloss error, wherein the valve control means manipulates the steam valves of each manifold so that the sum of all steam valve openings remains a constant value; and steam pressure controller means, responsive to the computer means, for adjusting the primary and secondary inlet valves to minimize the machine-directional gloss error.

8. A multiple steam applicator controller for controlling the formation of a gloss finish of a web, comprising:

a primary steam applicator located adjacent the web, the primary steam applicator having a manifold, a primary inlet valve, and a plurality of steam valves spaced along the primary manifold, each steam valve regulating a steam flow distributed to a cross-directional section of the web;

a secondary steam applicator located spaced from the primary steam applicator in a machine-direction and adjacent the web, the secondary steam applicator having a manifold, a secondary inlet valve, and a plurality of steam valves spaced along the secondary manifold, each steam valve regulating the steam flow rate delivered to a cross-directional section of the web;

a gloss sensor for measuring a degree of gloss at each cross-directional section of the web and producing an electrical signal in response thereto;

an analog-to-digital converter for converting each of the electrical signals into a digital floating point value indicative of the gloss measurement;

computer means, in communication with and responsive to the gloss sensor, structured for storing the gloss measurements, for periodically computing an average of the gloss measurements, for determining an average gloss error by subtracting the average of the gloss measurements from a predetermined average gloss value, for computing the total steam flow required to minimize the average gloss error, for converting the required total steam flow to a required pressure in the primary manifold, for determining a gloss error for a cross-directional section by subtracting a gloss measurement from a predetermined gloss target for the cross-directional section, for computing the steam flow required to minimize the cross-directional gloss error;

a primary steam pressure controller, responsive to the computer means, for adjusting the primary inlet valve to achieve the required pressure determined by the computer means;

a secondary steam pressure controller, responsive to the computer means, for adjusting the secondary inlet valve so that the steam flow ratio of the primary and secondary steam applicators is a substantially constant value; and a valve control device, responsive to the computer means, for adjusting the opening of each steam valve of the primary and secondary steam applicators so that the steam flow from each valve minimizes the gloss error for each cross-directional section of the web, and so that the total steam flow minimizes the average gloss error, and so that the total of all steam valve openings is a substantially constant value.

9. A method of controlling a plurality of steam applicators disposed apart from each other in a machine-direction and adjacent a calender stack to control the gloss finish of a web during calendering, comprising:

measuring the gloss of each cross-directional section of the web;

computing a machine-directional gloss error by subtracting a predetermined average gloss value from an average of the cross-directional gloss measurements;

adjusting a steam flow rate from each of a plurality of steam applicators to minimize the machine-directional gloss error;

computing a cross-directional gloss error by subtracting a predetermined gloss value from the gloss measurement for a cross-directional section; and adjusting a steam flow rate from a plurality of steam valves openings to minimize the cross-directional gloss error, wherein adjusting the steam valves openings does not affect the total steam flow rate from the plurality of steam applicators.

10. A method for controlling the gloss formation of a web by controlling a plurality of steam applicators which are spaced from one another in a machine-direction, each stream applicator having a manifold with a plurality of steam valves spaced along the manifold, each steam valve regulating the steam flow distributed to a cross-directional section of the web, comprising the steps of:

measuring a degree of gloss at each cross-directional section of the wb and producing a first signal in response thereto;

computing an average of the gloss measurements;

computing an average gloss error by subtracting the average of the gloss measurements from a predetermined gloss average and producing a second signal in response thereto;

adjusting the steam pressure of the plurality of steam applicators in response to the second signal so that the total steam flow from the steam applicators to the web minimizes the average gloss error;

computing a gloss error at each cross-directional section of the web by subtracting a gloss measurement from a predetermined gloss target for the cross-directional section and producing a third signal in response thereto; and adjusting the opening of the plurality of steam valves in response to the third signal so that the steam flow from each steam valve minimizes the gloss error at each cross-directional section such that the sum of all the steam valve openings of each steam applicator remains a constant value.

* * * * *